US009343833B2

(12) United States Patent
Tiegs et al.

(10) Patent No.: US 9,343,833 B2
(45) Date of Patent: May 17, 2016

(54) DEVICE FOR CONNECTING A FIRST ELECTRIC CABLE TO A SECOND ELECTRIC CABLE, DISTRIBUTOR ARRANGEMENT AND AIR- OR SPACECRAFT

(75) Inventors: Detlef Tiegs, Bremen (DE); Merten Helms, Bremen (DE)

(73) Assignee: Airbus Operations GMBH, Hamburg (DE)

( * ) Notice: Subject to any disclaimer, the term of this patent is extended or adjusted under 35 U.S.C. 154(b) by 0 days.

(21) Appl. No.: 13/189,730

(22) Filed: Jul. 25, 2011

(65) Prior Publication Data

US 2012/0021635 A1 Jan. 26, 2012

Related U.S. Application Data

(60) Provisional application No. 61/367,589, filed on Jul. 26, 2010.

(30) Foreign Application Priority Data

Jul. 26, 2010 (DE) ..... 10 2010 038407

(51) Int. Cl.

| | |
|---|---|
| ***H01R 13/627*** | (2006.01) |
| ***H01R 13/04*** | (2006.01) |
| ***H01R 11/00*** | (2006.01) |
| ***H01R 13/10*** | (2006.01) |

(52) U.S. Cl.

CPC ..... *H01R 13/04* (2013.01); *H01R 11/00* (2013.01); *H01R 13/10* (2013.01)

(58) Field of Classification Search

CPC ..... H01R 13/04; H01R 13/10; H01R 11/00

USPC ..... 439/359, 502, 578, 835

See application file for complete search history.

(56) References Cited

U.S. PATENT DOCUMENTS

| | | | | |
|---|---|---|---|---|
| 2,346,831 | A * | 4/1944 | Drury | 439/839 |
| 3,316,528 | A * | 4/1967 | Juris et al. | 439/839 |
| 3,924,922 | A | 12/1975 | DeCenzo | |
| 4,090,759 | A * | 5/1978 | Herrmann, Jr. | 439/281 |
| 4,296,986 | A | 10/1981 | Herrmann, Jr. | |
| 4,755,076 | A * | 7/1988 | Salama et al. | 403/275 |
| 4,911,654 | A * | 3/1990 | Blaetz | 439/372 |

(Continued)

FOREIGN PATENT DOCUMENTS

| | | |
|---|---|---|
| EP | 0 406 102 | 1/1991 |

OTHER PUBLICATIONS

Office Action from the German Patent Office in the corresponding priority application 10 2010 038 407.0-34.

*Primary Examiner* — Jean F Duverne

(74) *Attorney, Agent, or Firm* — Greer, Burns & Crain, Ltd.

(57) ABSTRACT

The present invention provides a device for connecting a first electric cable to a second electric cable, said device comprising: a first cable lug which comprises a first connection portion for electrically contacting the first electric cable and a socket portion having a conical socket; a second cable lug which comprises a second connection portion for electrically contacting the second electric cable and a plug portion having a conical plug; wherein the plug can be inserted into the socket and conductively contacted therewith in order to connect the first cable to the second cable in an electrically conductive manner.

16 Claims, 5 Drawing Sheets

(56) References Cited

U.S. PATENT DOCUMENTS

| | | | | | |
|---|---|---|---|---|---|
| 4,929,184 | A * | 5/1990 | Emadi et al. | 439/681 |
| 4,990,095 | A * | 2/1991 | Walkup | 439/152 |
| 4,997,380 | A * | 3/1991 | Etienne et al. | 439/127 |
| 5,197,908 | A * | 3/1993 | Nelson | 439/825 |
| 5,580,266 | A * | 12/1996 | Shelly | 439/281 |
| 5,921,803 | A * | 7/1999 | Mori | 439/387 |
| 6,176,719 | B1 * | 1/2001 | Williams et al. | 439/213 |
| 6,254,403 | B1 * | 7/2001 | Bernardini | 439/95 |
| 6,398,578 | B1 * | 6/2002 | Huang | 439/369 |
| 6,520,800 | B1 * | 2/2003 | Michelbach et al. | 439/578 |
| 6,899,572 | B1 * | 5/2005 | Baker et al. | 439/851 |
| 6,955,569 | B2 * | 10/2005 | Baker et al. | 439/839 |
| 7,214,095 | B1 * | 5/2007 | Mathews | 439/578 |
| 7,625,252 | B2 * | 12/2009 | Flynn et al. | 439/814 |
| 2004/0082218 | A1 * | 4/2004 | Stirling | 439/587 |
| 2006/0205284 | A1 * | 9/2006 | Wells | 439/784 |
| 2008/0318463 | A1 * | 12/2008 | Chen et al. | 439/359 |
| 2011/0250774 | A1 * | 10/2011 | Raad et al. | 439/271 |
| 2012/0021634 | A1 * | 1/2012 | Stauch et al. | 439/359 |

* cited by examiner

DEVICE FOR CONNECTING A FIRST ELECTRIC CABLE TO A SECOND ELECTRIC CABLE, DISTRIBUTOR ARRANGEMENT AND AIR- OR SPACECRAFT

CROSS-REFERENCE TO RELATED APPLICATIONS

This application claims the benefit of U.S. Provisional Application No. 61/367,589, filed Jul. 26, 2010 and German patent application No. 10 2010 038 407.0, filed Jul. 26, 2010, the entire disclosures of which are herein incorporated by reference.

FIELD OF THE INVENTION

The present invention relates to a device for connecting a first electric cable to a second electric cable, a distributor arrangement and an air- or spacecraft.

BACKGROUND OF THE INVENTION

Although applicable to any air- or spacecrafts, the present invention and the problem on which it is based will be described hereinafter in greater detail with reference to an aircraft.

It is known to equip aircrafts with at least one generator which is accommodated in an engine nacelle of the aircraft. The generator is driven by a turbine of the engine arranged in the engine nacelle in order to generate electric current. In order to provide consumers in the fuselage of the aircraft with electric current, the current from the engine nacelle must be guided into the fuselage of the aircraft through a wing.

Owing to the fact that, nowadays, the different aircraft components are manufactured at different locations and are then assembled together, predefined connection points between the different components are provided.

This results in the problem that the generator cannot be connected to the consumers inside the fuselage of the aircraft via a single continuous cable. Instead, it is necessary to provide a plurality of cables which are provided in the region of the connection points and can be interconnected.

In order to connect the electric cables it is normal to use a distributor 1, as illustrated perspectively in FIG. 1.

The distributor 1 basically comprises a flat plate 2 on which a plurality of pins 3 are arranged. The pins 3 extend substantially mutually parallel and are separated from one another by means of a separator element 4 in order to avoid, in particular, any spark-over. As is shown in FIG. 1 merely for one pin 3 by way of example, each of the pins 3 connects a first cable 5 to a second cable 6. For this purpose, the cables 5, 6 comprise cable lugs (not shown in FIG. 1) at their respective ends. The two cable lugs are slid over the pins 3 and are pressed against one another by means of a nut 7, in such a way that the first cable 5 is connected to the second cable 6 in an electrically conductive manner.

In the case of the known solution described above, one drawback proved to be that it was relatively complex in terms of assembly to slide the cable lugs over the pins 3 and to subsequently position and tighten the nuts 7. In addition, the construction of the distributor 1 predetermines the course of the cable 5. This can hinder, in part, the versatile guidance of the cable through the aircraft. Furthermore, the distributor 1 is relatively large and heavy.

One aspect of the present invention is therefore to provide a solution which at least mitigates the above-described drawbacks.

SUMMARY OF THE INVENTION

Accordingly, a device is provided for connecting a first electric cable to a second electric cable, said device comprising: a first cable lug which comprises a first connection portion for electrically contacting the first electric cable and a socket portion having a conical socket; a second cable lug which comprises a second connection portion for electrically contacting the second electric cable and a plug portion having a conical plug; wherein the plug can be inserted into the socket and conductively contacted therewith in order to connect the first cable to the second cable in an electrically conductive manner.

Furthermore a distributor arrangement is provided, comprising: a plurality of first cables; a plurality of the second cables; and a plurality of devices according to the invention, each of which connects a first and second cable in an electrically conductive manner.

Furthermore an aircraft or spacecraft is provided, comprising: a first component; a second component; and the distributor arrangement according to the invention, wherein the first cables extend in the first component and the second cables extend in the second component.

One idea is to dispense completely with the distributors described in detail and to provide an individual connection of the respective cable by means of one device. The device is characterised in that the first and second cables can be connected easily in terms of assembly by inserting the plug into the socket. This is also additionally simplified since the socket and plug are conical, such that a type of insertion aid is produced. In addition, the connection formed of a conical socket and conical plug constitutes a connection which is capable of bearing high loads.

A further advantage is that the device makes it possible to connect the first and second cables to one another along a freely selectable route within the aircraft. The need indicated in the introduction to guide the first and second cables to a distributor is thus eradicated.

Advantageous developments of the device according to the invention and of the distributor arrangement according to the invention will emerge from the dependent claims.

In accordance with a development of the device according to the invention, the conical plug is formed as solid matter. The plug is therefore capable of bearing particularly high loads.

In accordance with a further development of the device according to the invention, the first or second cable lug holds a sleeve comprising a thread which can be screwed together with a counter-thread of the respective other cable lug in order to thus hold the plug and socket in contact. It is thus possible to permanently fix the plug in electrically conductive contact with the socket in a simple manner.

In accordance with a further development of the device according to the invention, the sleeve is formed at one of its ends with a holding means which can be brought into engagement in the axial direction with the first or second cable lug, and is formed at its other end with the thread which can be screwed together with the counter-thread on the respective other cable lug. The plug is thus drawn into the socket in a fixed manner by screwing the thread together with the counter-thread.

In accordance with a further development of the device according to the invention, the holding means is formed as a conical tapering of the diameter of the sleeve which can be brought into engagement with a conical tapering of the diameter of the first or second cable lug to produce a frictional connection between the sleeve and the first or second cable lug. The frictional connection prevents the sleeve from rotating, such that said sleeve cannot automatically loosen when screwed together with the first or second cable lug.

In accordance with a further development of the device according to the invention, the thread on the sleeve is formed as an inner thread and the counter-thread on the first or second cable lug is formed as an outer thread.

In accordance with a further development of the device according to the invention, the first and/or second connection portion is sleeve-like and can be connected to the first or second cable by means of crimping. This makes it possible to fix the first or second connection portion to a respective cable in a simple manner.

In accordance with a development of the distributor arrangement according to the invention, the devices are arranged approximately over a circular line. In an aircraft, cables connecting the single generator to electric consumers in the aircraft are usually arranged over a circular line, as viewed in cross-section. This is due to electromagnetic reasons. If the devices are now used at a connection point to connect the cables to one another, the circular (in cross-section) arrangement is maintained, which is not the case with the distributor described in the introduction.

BRIEF DESCRIPTION OF THE DRAWINGS

The invention will now be described in greater detail by way of embodiments with reference to the accompanying figures of the drawings, in which.

In the figures, like reference numerals denote like or functionally equivalent components, unless stated otherwise.

DETAILED DESCRIPTION OF THE INVENTION

Figure 1:
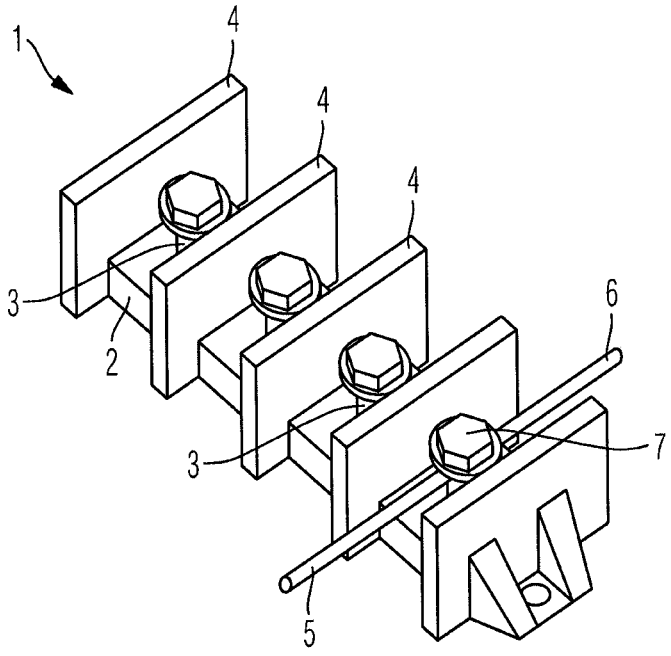
FIG. 1 is a perspective view of a known distributor.
Figure 2:
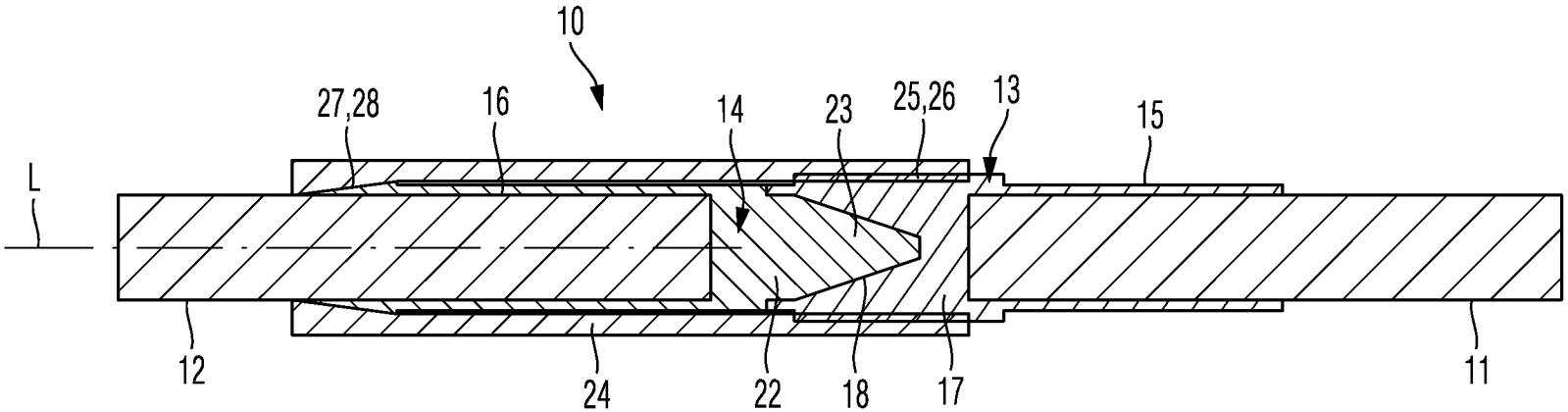
FIG. 2 is a longitudinal sectional view of a device including a first and second cable according to an embodiment of the present invention.

FIG. 2 shows a device 10, in a first longitudinal section, including a first cable 11 and a second cable 12 according to an embodiment of the present invention.

The device 10 comprises a first cable lug 13 and a second cable lug 14. The first cable lug 13 is connected to the first cable 11 in an electrically conductive manner by means of a first connection portion 15. The second cable lug 14 is connected to the second cable 12 in an electrically conductive manner by means of a second connection portion 16. The first connection portion 15 is connected to the first cable 11, and the second connection portion 16 is connected to the second cable 12, for example by means of crimping the respective sleeve-like connection portion 15, 16.

The first cable lug 13 further comprises a socket portion 17 which can be connected integrally to the first connection portion 15. The socket portion 17 is formed with a conical socket 18.

The second cable lug 14 comprises a plug portion 22 which can be formed in one piece with the second connection portion 16. The plug portion 22 comprises a conical plug 23.

In order to connect the first cable 11 to the second cable 12 in an electrically conductive manner, the plug 23 is inserted into the socket 18, as illustrated in FIG. 2. The plug 23 and the socket 18 lie in electrically conductive contact against one another.

The plug 23 is preferably formed of a solid material, for example aluminium. The socket 18 may also be formed of aluminium.

The second cable lug 14 holds a sleeve 24. The sleeve 24 is formed at one of its ends with a thread 25 which, in the state illustrated in FIG. 2, is screwed together with the counter-thread 26 of the first cable lug 13. The thread 25 is an inner thread and the counter-thread 26 is an outer thread.

The sleeve 24 thus connects the first cable lug 13 to the second cable lug 14 and ensures that the plug 23 remains in electrically conductive contact with the socket 18.

The first cable lug 13, the second cable lug 14 and the sleeve 24 are preferably arranged coaxially. The sleeve 24 surrounds the second cable lug 14 when the device 10 is fully connected, as illustrated in FIG. 2.

The sleeve 24 is held on the second cable lug since the sleeve 24 comprises a conical tapering 27 at its other end. The conical tapering 27 is frictionally engaged with a conical tapering 28 of the second cable lug 14 in the state illustrated in FIG. 2. This is achieved in that the tapering 28 is pressed into the tapering 27 when the thread 25 is screwed onto the counter-thread 26. The resulting frictional connection produced between the tapering 27 and the tapering 28 reliably prevents the screw connection between the thread 25 and the counter-thread 26 from loosening automatically.

If the sleeve 24 is unscrewed from the first cable lug 13, said sleeve moves to the left along the longitudinal direction L in FIG. 2. As soon as the thread 25 and the counter-thread 26 are out of engagement, the first cable lug 13 and the second cable lug 14 can be separated from one another and the plug 23 can thus be withdrawn from the socket 18.

Figure 3:
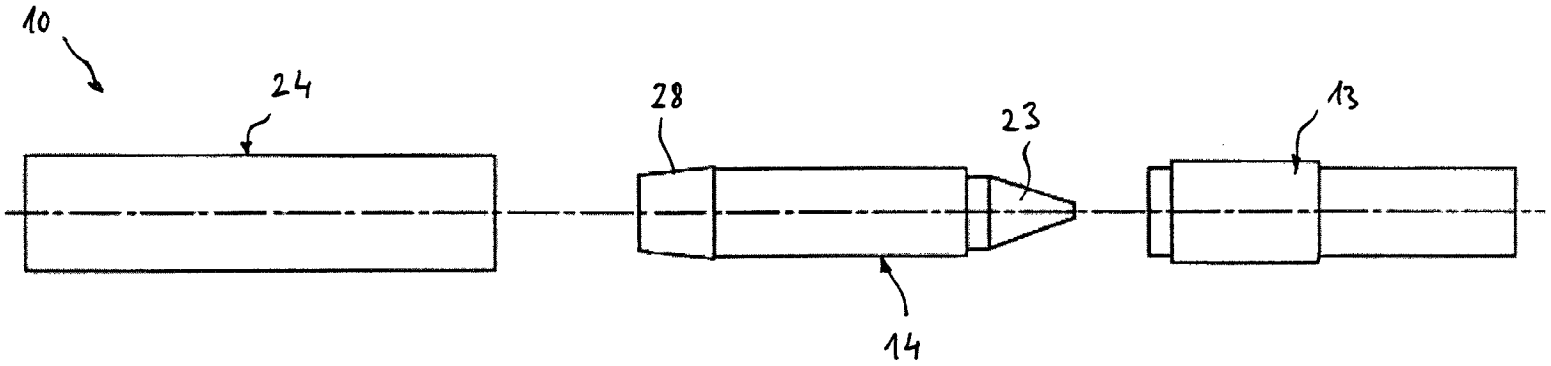
FIG. 3 is an exploded view of the device from FIG. 2.
Figure 4:
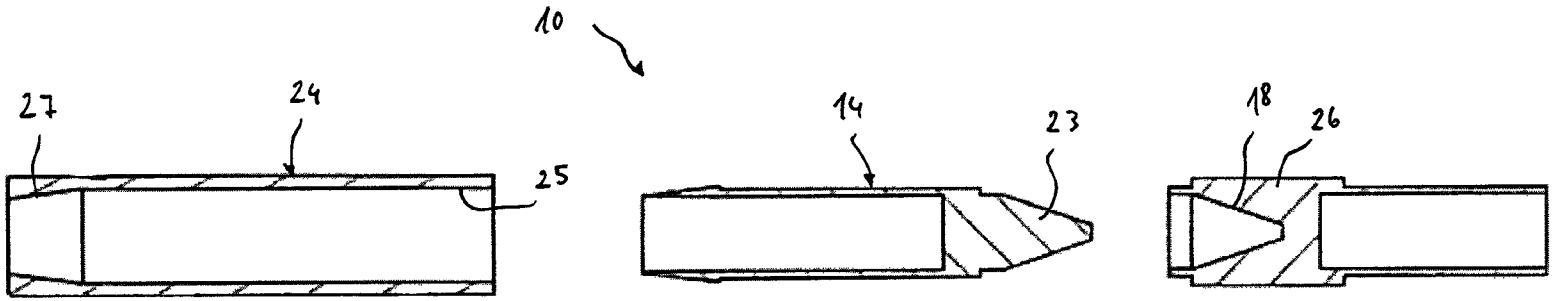
FIG. 4 is a longitudinal sectional view through the device from FIG. 3.

FIG. 3 shows an exploded view of the device 10 from FIG. 2, and FIG. 4 shows a longitudinal section of the device 10 as illustrated in FIG. 3.

The construction of the device 10 described in connection with FIG. 2 will again become particularly clear with reference to FIGS. 3 and 4.

Figure 5:
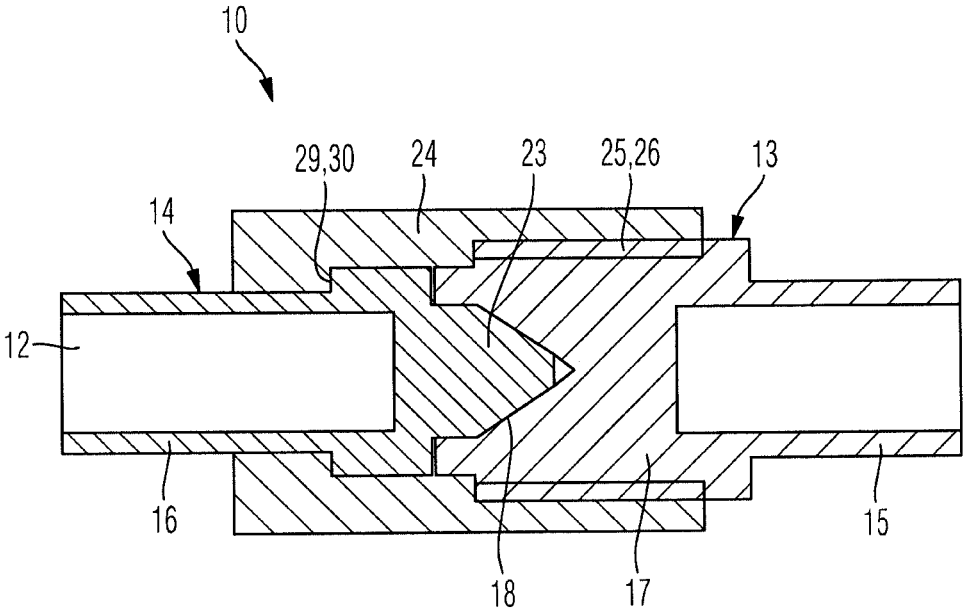
FIG. 5 is a longitudinal sectional view through a device according to a further embodiment of the present invention.

FIG. 5 shows a longitudinal section through a device 10 according to a further embodiment of the present invention. Merely the differences from the embodiment according to FIGS. 2 to 4 will be discussed hereinafter.

Instead of the conical tapering 27 as illustrated in FIG. 2, the sleeve 24 in the embodiment according to FIG. 5 is formed with a shoulder 29. When the sleeve 24 is screwed onto the first cable lug 13, the shoulder 29 abuts a corresponding shoulder 30 of the second cable lug 14. The first and second cable lugs 13, 14 are thus held against one another in a fixed manner.

Figure 6:
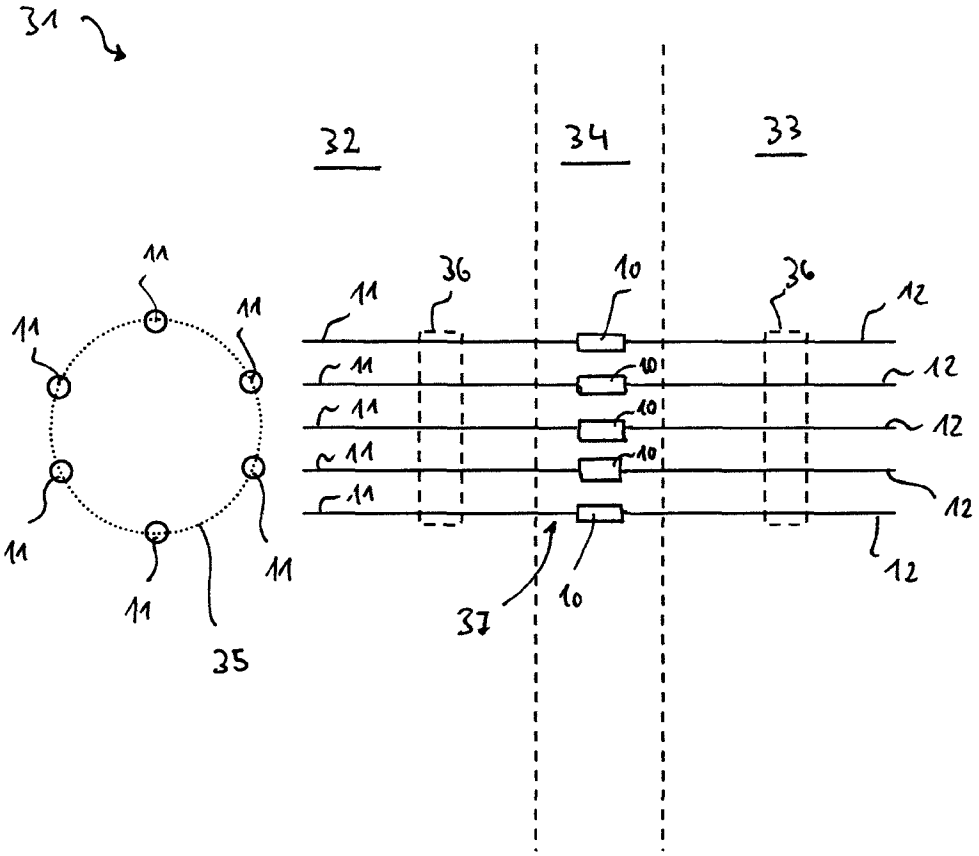
FIG. 6 shows a detail from an aircraft according to an embodiment of the present invention.

FIG. 6 shows a detail from an aircraft 31. The aircraft 31 comprises a first component in the form of a wing 32 and a second component in the form of a fuselage 33 which are interconnected in the region of a connection point 34 when the aircraft 31 is assembled.

A plurality of first cables 11 extend in the wing 32 and, as shown in FIG. 6 by a dotted line, are arranged over a circular line 35 when viewed in cross-section. This arrangement of the first cables 11 is achieved since the first cables 11 are held in the wing 32 by means of 'bobbins' 36.

In the region of the connection point 34, each of the first cables 11 is connected to a second cable 12 by means of the device 10 illustrated in FIGS. 2 to 4 or in FIG. 5. The second cables 12 are arranged in accordance with the first cables 11 and also held by means of one or more bobbins 36. For example, the first and second cables 11, 12 and the devices 10 connect a generator (not shown), which is arranged in or on the wing 32, to electric consumers (not shown) in the fuselage 33 of the aircraft 31.

The devices 10 are arranged over the circular line 35 when viewed in cross-section, similarly to the first and second cables 11, 12. A path of the cables 11, 12 in the region of the connection point 34 therefore does not need to be changed.

The devices 10, together with the cables 11, 12, form a distributor arrangement 37.

Although the present invention has been described with reference to preferred embodiments, it is in no way limited to these embodiments and can be modified in a versatile manner. In particular, the developments and embodiments described for the device spacecraft according to the invention, and vice versa. Furthermore, "a" or "one" presently does not exclude a plurality.

The invention claimed is:

1. Device for connecting a first electric cable to a second electric cable, said device comprising:

a first cable lug which comprises a first connection portion for electrically contacting the first electric cable and a socket portion having a conical socket;

a second cable lug which comprises a second connection portion for electrically contacting the second electric cable and a plug portion having a conical plug; and a sleeve configured to extend over the first and second cable lugs;

wherein the plug is inserted into the socket such that conical surfaces of the plug and the socket make conductive contact with one another in order to connect the first cable to the second cable in an electrically conductive manner; and wherein the first cable lug or the second cable lug holds the sleeve, the sleeve having a thread configured to be screwed together with a counter-thread of the respective other cable lug in order to hold the plug and socket in contact.

2. Device according to claim 1, wherein the conical plug is formed as solid material.

3. Device according to claim 1, wherein the sleeve is formed at one of its ends with a holding means to be brought into engagement in the axial direction with the first or second cable lug, and is formed at its other end with the thread to be screwed together with the counter-thread on the respective other cable lug.

4. Device according to claim 3, wherein the holding means is formed as a conical tapering of the diameter of the sleeve to be brought into engagement with a conical tapering of the diameter of the first or second cable lug to produce a frictional connection between the sleeve and the first or second cable lug.

5. Device according to claim 1, wherein the thread on the sleeve is formed as an inner thread and the counter-thread on the first or second cable lug is formed as an outer thread.

6. Device according to claim 1, wherein the first and/or second connection portion is sleeve-like and can be connected to the first or second cable by means of crimping.

7. Distributor arrangement comprising:

a plurality of first cables;

a plurality of second cables; and a plurality of devices according to claim 1, each of which connects a first and second cable in an electrically conductive manner.

8. Distributor arrangement according to claim 7, wherein the devices are arranged approximately over a circular line.

9. Air- or spacecraft comprising:

a first component;

a second component;

and a distributor arrangement according to claim 7, wherein the first cables extend in the first component and the second cables extend in the second component.

10. Cable connector device for connecting a first electric cable to a second electric cable, comprising:

a first lug comprising a first connection portion for electrical connection with the first electric cable and a socket portion having a conical socket;

a second lug comprising a second connection portion for electrical connection with the second electric cable and a plug portion having a conical plug; and a sleeve which extends over the first and second cable lugs;

wherein the conical plug is configured for insertion into the conical socket, whereby conical surfaces of the plug and the socket make electrically conductive contact to connect the first cable to the second cable in an electrically conductive manner; and wherein the first cable lug or the second cable lug holds the sleeve, the sleeve comprising a thread configured to be screwed together with a counter-thread of the respective other cable lug in order to hold the plug and socket in contact.

11. Cable connector device according to claim 10, wherein the first connection portion is at one end region of the first lug and the socket portion is at an opposite end region of the first lug.

12. Cable connector device according to claim 10, wherein the second connection portion is at one end region of the second lug and the plug portion is at an opposite end region of the second lug.

13. Cable connector device according to claim 10, wherein the sleeve is formed at one of its ends with a holding means to be brought into engagement in the axial direction with the first or second lug, and is formed at its other end with the thread to be screwed together with the counter-thread on the respective other cable lug.

14. Cable connector device according to claim 13, wherein the holding means is formed as a conical tapering of the diameter of the sleeve to be brought into engagement with a conical tapering of the diameter of the first or second lug to produce a frictional connection between the sleeve and the first or second lug.

15. Distributor arrangement comprising:

a plurality of first cables;

a plurality of second cables; and a plurality of cable connector devices according to claim 10, each of which connects one of the first cables and one of the second cables in an electrically conductive manner.

16. Aircraft or spacecraft comprising:

a first component;

a second component; and a distributor arrangement according to claim 15, wherein the first cables extend in the first component and the second cables extend in the second component.

* * * * *